US009415481B2

(12) United States Patent
Chou

(10) Patent No.: US 9,415,481 B2
(45) Date of Patent: Aug. 16, 2016

(54) CHEMICAL MECHANICAL POLISHING CONDITIONER WITH HIGH QUALITY ABRASIVE PARTICLES

(71) Applicant: Kinik Company, Taipei (TW)

(72) Inventor: Jui-Lin Chou, Hualien County (TW)

(73) Assignee: KINIK COMPANY, Taipei (TW)

( * ) Notice: Subject to any disclaimer, the term of this patent is extended or adjusted under 35 U.S.C. 154(b) by 5 days.

(21) Appl. No.: 14/574,171

(22) Filed: Dec. 17, 2014

(65) Prior Publication Data

US 2015/0202736 A1 Jul. 23, 2015

(30) Foreign Application Priority Data

Jan. 20, 2014 (TW) ..... 103101986 A

(51) Int. Cl.
*B24B 53/00* (2006.01)
*B24B 53/017* (2012.01)

(52) U.S. Cl.
CPC ..... *B24B 53/017* (2013.01)

(58) Field of Classification Search
CPC ..... B24B 53/017; B24B 53/12; B24D 3/06; B07C 5/342; B07C 5/34
USPC ..... 451/443, 56; 209/576, 577, 938
See application file for complete search history.

(56) References Cited

U.S. PATENT DOCUMENTS 4,082,185 A * 4/1978 Strong ..... B01J 3/062 206/525
5,035,771 A * 7/1991 Borse ..... C04B 41/53 216/75
7,778,458 B2 * 8/2010 Hiraoka ..... B07C 5/14 382/141
8,916,049 B2 * 12/2014 Nishijima ..... B03C 1/286 209/214
2001/0033684 A1 * 10/2001 Suzuki ..... F16G 5/16 382/152
2002/0137434 A1 * 9/2002 Choi ..... B24B 37/20 451/28
2005/0137077 A1 * 6/2005 Bange ..... B24D 18/00 501/127
2005/0144980 A1 * 7/2005 Shaw ..... A44C 17/02 63/26
2006/0199471 A1 * 9/2006 Bajaj ..... B23K 26/0066 451/5
2006/0270322 A1 * 11/2006 Yilmaz ..... B24B 53/017 451/8

(Continued)

FOREIGN PATENT DOCUMENTS

CN 102706742 A * 10/2012

*Primary Examiner* — George Nguyen
(74) *Attorney, Agent, or Firm* — Muncy, Geissler, Olds & Lowe, P.C.

(57) ABSTRACT

The present invention relates to a chemical mechanical polishing conditioner with high quality abrasive particles, comprising a substrate; a bonding layer disposed on the substrate; and a plurality of abrasive particles placed on the bonding layer, and the abrasive particles are placed on the substrate by the bonding layer; wherein the abrasive particles have a risk diamond content measured by a screening apparatus for screening abrasive particles. Therefore, the chemical mechanical polishing conditioner with high quality abrasive particles is produced, after the risk diamond content is judged by the screening apparatus for screening abrasive particles; thereby avoiding scratches and breakages produced on the polishing pad due to the risk diamonds during a chemical mechanical polishing process.

16 Claims, 3 Drawing Sheets

(56) References Cited

U.S. PATENT DOCUMENTS

2007/0049168 A1* 3/2007 Fujita ..... B24B 53/017 451/6
2007/0049185 A1* 3/2007 Lin ..... B24D 3/14 451/443
2008/0140248 A1* 6/2008 Moore ..... B07C 5/14 700/223
2008/0271384 A1* 11/2008 Puthanangady ..... B24B 53/017 51/309
2009/0120848 A1* 5/2009 Schaefer ..... B07B 1/00 209/577
2011/0143640 A1* 6/2011 Bajaj ..... B23K 26/0075 451/56
2011/0147277 A1* 6/2011 Harding ..... B07C 5/344 209/4
2013/0192144 A1* 8/2013 Twitchen ..... B24D 99/00 51/307
2014/0335761 A1* 11/2014 Chou ..... B24B 49/12 451/5

* cited by examiner

CHEMICAL MECHANICAL POLISHING CONDITIONER WITH HIGH QUALITY ABRASIVE PARTICLES

CROSS REFERENCE TO RELATED APPLICATION

This application claims the benefits of the Taiwan Patent Application Serial Number 103101986, filed on Jan. 20, 2014, the subject matter of which is incorporated herein by reference.

BACKGROUND OF THE INVENTION

1. Field of the Invention

The present invention relates to a chemical mechanical polishing conditioner with high quality abrasive particles, and more particularly to a chemical mechanical polishing conditioner with high quality abrasive particles which is manufactured after judging a content of risk diamonds through an abrasive screening device.

2. Description of Related Art

Chemical mechanical polishing (CMP) is a common polishing process in various industries, which can be used to grind the surfaces of various articles, including ceramics, silicon, glass, quartz, or a metal chip. In addition, with the rapid development of integrated circuits, chemical mechanical polishing becomes one of the common techniques for wafer planarization because it can achieve an object of whole planarization.

During the chemical mechanical polishing process of semiconductor, impurities or uneven structure on the surface of a wafer are removed by contacting the wafer (or the other semiconductor elements) with a polishing pad and using a polishing liquid if necessary, through the chemical reaction and mechanical force. When the polishing pad has been used for a certain period of time, the polishing performance and efficiency are reduced because the debris produced in the polishing process may accumulate on the surface of the polishing pad. Therefore, a conditioner can be used to condition the surface of the polishing pad, such that the surface of the polishing pad is re-roughened and maintained at an optimum condition for polishing. In the process for manufacturing a conditioner, it is necessary to dispose an abrasive layer by mixing abrasive particles and a binding layer on the substrate surface, and to fix the abrasive layer to the surface of the substrate by brazing or sintering methods. However, during the manufacturing process of the above conditioner, or when the conditioner conditions a polishing pad, the diamond particles on the conditioner may be broken; this is so called risk diamonds, such that the conditioner may become a defective one. Therefore, it is necessary to implement a detection process and remove risk diamonds to ensure an expected polishing effect in the subsequent steps. It is a known method to use an optical microscope (OM) to perform a visual observation whether a pad conditioner has any risk diamond or not. When risk diamonds are observed, the positions would be marked by a marked method (such as oil pen) and taken a photograph. Finally, the photos are taken before and after the grinding process which would be compared by a person, and the risk diamonds are removed by a person or a mechanical method to avoid the risk diamonds residue on the conditioner.

In the known technology, such as Taiwan Patent Application No. 102128225 filed by the Applicant, it discloses a detection apparatus of chemical mechanical polishing conditioner, comprising: a working platform with a working plane; a placement base disposed on the working plane of the working platform for carrying a chemical mechanical polishing conditioner; an image capture device forming one or a plurality of captured images for different regions of the chemical mechanical polishing conditioner; a display device; an image recognition module is a color matching the captured images to determine one or a plurality of risk diamond on the chemical mechanical polishing conditioner, and output the coordinate location of the risk diamond to the display device; and a mobile platform move the risk diamond to a specified location. A detection method of the above mentioned detection apparatus is also disclosed.

Besides, in the other known technology, such as Taiwan Patent Application No. 102116516 filed by the Applicant, it discloses a diamond screening apparatus, comprising: a working platform with a working plane; a conveyer disposed on the working plane of the working platform for carrying a diamond matrix unit; an image capture device forming one or a plurality of captured images for different regions of the diamond matrix unit; a display device; and an image recognition module, which is electrically connected to the image capture device and the display device, performs a geometric feature analysis on the captured images to determine one or a plurality of risk diamonds of the diamond matrix unit.

However, the diamond particles fixed on the conditioner are perform a geometric feature parameter analysis and a color matching by an image treatment in the above-mentioned detectors, thereby judging existence and positions of the risk diamonds and removing the risk diamonds by a suitable removing device to reduce the polished workpiece (such as the polishing pad) destroyed by these risk diamonds and maintain polishing performance and quality. However, the known detectors are used to decide the polishing performance of the chemical mechanical polishing conditioner, but the above-mentioned detectors still cannot improve yield rate for the product of the chemical mechanical polishing conditioner. Therefore, there is an urgent need for a chemical mechanical polishing conditioner with an abrasive screening device by which the geometric feature parameter of these abrasive particles are measured to judge the risk diamond content of these abrasive particles, and the risk diamond content to be tolerated and whether these abrasive particles to be used to manufacture the chemical mechanical polishing conditioner or not are decided by the user, thereby avoiding scratches and breakages produced on the polishing pad due to the risk diamonds during a chemical mechanical polishing process.

SUMMARY OF THE INVENTION

An object of the present invention is to provide a chemical mechanical polishing conditioner with high quality abrasive particles, in which an abrasive screening device is used to judge the risk diamond content, thereby avoiding scratches and breakages produced on the polishing pad due to the risk diamonds during a chemical mechanical polishing process.

A known method for detecting the risk diamonds is mainly that the abrasive particles brazed on the chemical mechanical polishing conditioner are directly detected and removed them by a suitable removing tool, such as an artificial shaving device or a water jet device and so on, to remove the risk diamonds from the chemical mechanical polishing conditioner. However, if the risk diamonds are too much, a work for removing the risk diamonds becomes more complicated and wastes time, even the productivity of produces is reduced. Therefore, it is necessary that a detecting device and a method for the risk diamonds before producing the chemical mechanical polishing conditioner are developed, and the abrasive quality and production convenience of the chemical mechanical polishing conditioner are ensured simultaneously.

To achieve the above object, the present invention provides a chemical mechanical polishing conditioner with high quality abrasive particles, comprising: a substrate; a binding layer disposed on a surface of the substrate; and a plurality of abrasive particles embedded in a surface of the binding layer and fixed to the surface of the substrate by the binding layer; wherein these abrasive particles has a risk diamond content measured by an abrasive screening device.

In the chemical mechanical polishing conditioner with high quality abrasive particles of the present invention, the risk diamond content may be a number percentage of the abrasive particles having a twin crystal structure or an internal crack structure based on these abrasive particles; wherein a number percentage of the abrasive particles having the twin crystal structure based on these abrasive particles is a twinning rate which may be a quality index of the chemical mechanical polishing conditioner with high quality abrasive particles of the present invention. Further, the twin crystal structures are two diamonds grown together in which a crystal boundary is present, and diamonds may be easily broken in the crystal boundary while using. Therefore, the chemical mechanical polishing conditioner with high quality abrasive particles of the present invention may be control by the twinning rate, thereby steadying the quality of the chemical mechanical polishing conditioner. In the chemical mechanical polishing conditioner with high quality abrasive particles of the present invention, a tolerance of the risk diamond content of the conditioner may be randomly varied based on the user's requirements, wherein in an aspect of the present invention, the risk diamond content may be 20% or less, in another aspect of the present invention, the risk diamond content may be 10% or less, in the other aspect of the present invention, the risk diamond content may be 0%.

In the chemical mechanical polishing conditioner with high quality abrasive particles of the present invention, the abrasive screening device may be an image capture device, an image recognition module, and a display; wherein the image capture device may be random image capture devices which are random devices capable of capturing images, such as a camera or an industrial camera, and the image capture device may include a charge coupled device (CCD). Besides, the numbers of the captured images may be randomly varied based on resolutions of the image capture device or the user's detection standard, such as 1, 12, 24, 24, 108 captured images; wherein the image recognition module is electrically connected with the image capture device and the display, and the results of the captured images from the image recognition module are transmitted to the display to judge whether risk diamonds are present or not and the risk diamond content. Further, the risk diamond content to be tolerated and whether these abrasive particles to be used directly or not to manufacture a conditioner are decided by the user; alternatively, the risk diamonds are further removed by manual or mechanical methods, and then these abrasive particles are used to manufacture a conditioner.

In the chemical mechanical polishing conditioner with high quality abrasive particles of the present invention, every abrasive particle has a geometric feature parameter, and the geometric feature parameter is measured by the abrasive screening device to judge the risk diamond content. In the chemical mechanical polishing conditioner with high quality abrasive particles of the present invention, these risk diamonds are abrasive particles having twin crystal structures or internal crack structures, which are different from the general diamond particles with perfect crystal forms, and the geometric feature parameter of the risk diamonds may excess a tolerance of the geometric feature parameter of the general diamond particles. Therefore, whatever geometric feature parameters used to define the diamond particles may be used totally, so long as they may be used to judge the risk diamond content. For example, in an aspect of the present invention, the geometric feature parameters may be an ellipticity, a roundness, an aspect ratio, a roughness, an equivalent diameter, a maximum/most effective diameter, a rectangle degree, a shape factor, an optical character or a combination of different geometric feature parameters. More specifically, in an aspect of the present invention, the ellipticity and roughness as the geometric feature parameters judged the risk diamond content may be used selectively by the user; wherein the ellipticity is used to express a round flat level of an ellipse, which is defined as a ration of major axis and minor axis of a crystal ellipse, and if the numerical value is more close to 1, the shape thereof is more round. Besides, the roughness is used to express the surface defect degree of the crystal, which is defined as a ration of an actual area of crystal projection (AreaC) based on the encircled area (AreaF) after crystal projection, namely, the roughness=(AreaC/AreaF)*100%. Hereby, the geometric feature parameters of every diamond particle may be obtained through the image recognition module by the user, and a standard parameter is set according to requirements of the conditioner by the user, thereby screening out the risk diamond content having the geometric feature parameters beyond the standard parameter. In the chemical mechanical polishing conditioner with high quality abrasive particles of the present invention, the user may judge the geometric feature parameters of the risk diamond content through the ellipticity; wherein the ellipticity is a ration of the maximum outside diameter based on the minimum outside diameter. If a circular form has a uniform outside diameter, the ellipticity is 1, and when the measured ellipticity is beyond the tolerant range or the standard parameter, the risk diamond content may be calculated. In an aspect of the present invention, the ellipticity may be 1.0 to 1.6, and in another aspect of the present invention, the ellipticity may be 1.0 to 1.4. Besides, in the chemical mechanical polishing conditioner with high quality abrasive particles of the present invention, the geometric feature parameters of the risk diamond content may be judged through the roughness by the user; wherein the roughness is that a surface morphology of the abrasive particles is measured by a surface roughometer. When the measured roughness is beyond the tolerant range or the standard parameter, the risk diamond content may be determined, in an aspect of the present invention, the roughness may be 1.00 to 1.10, and in another aspect of the present invention, the roughness may be 1.00 to 1.08.

In the chemical mechanical polishing conditioner with high quality abrasive particles of the present invention, these abrasive particles can be artificial diamonds, nature diamonds, polycrystalline diamonds or cubic boron nitride. In a preferred aspect of the present invention, these abrasive particles may be artificial diamonds. Furthermore, in above-mentioned the chemical mechanical polishing conditioner with high quality abrasive particles of the present invention, these abrasive particles may have a particle size of 30 to 600 μm. In an aspect of the present invention, the abrasive particles may have a particle size of 200 μm.

In the chemical mechanical polishing conditioner with high quality abrasive particles of the present invention, the compositions of the binding layer may be varied based on the polishing conditions and user's requirements, which includes: a ceramic material, a brazing material, an electroplating material, a metallic material, or a polymer material, but the present invention is not limited thereto. In an aspect of the present invention, the binding layer can be made of a brazing material, wherein the brazing material can be at least one selected from the group consisting of iron, cobalt, nickel, chromium, manganese, silicon, aluminum, and combinations thereof. In another aspect of the present invention, the binding layer can be made of a polymer material, and the polymer material can be epoxy resin, polyester resin, polyacrylic resin, or phenolic resin. Besides, in above-mentioned the chemical mechanical polishing conditioner with high quality abrasive particles of the present invention, the materials and sizes of the substrate may be varied based on the polishing conditions and requirements; wherein the materials of the substrate can be stainless steel, mold steel, metal alloy, ceramic material or polymer material etc., but the present invention is not be limited thereto. In a preferred aspect of the present invention, the material of the substrate may be a stainless steel substrate.

In summary, according to the chemical mechanical polishing conditioner with high quality abrasive particles of the present invention, the risk diamond content is judged by the abrasive screening device, and then these abrasive particles are used to manufacture the chemical mechanical polishing conditioner with high quality abrasive particles, thereby improving quality of abrasive particles of the chemical mechanical polishing conditioner. Besides, the risk diamond content of the chemical mechanical polishing conditioner with high quality abrasive particles of the present invention is judged by the geometric feature parameters, and the risk diamond content to be tolerated and whether these abrasive particles to be used directly or not to manufacture a conditioner are decided by the user, thereby avoiding scratches and breakages produced on the polishing pad due to the risk diamonds during a chemical mechanical polishing process.

BRIEF DESCRIPTION OF THE DRAWINGS

The above and other objects, features and other advantages of the present invention will be more clearly understood from the following detailed description taken in conjunction with the accompanying drawings, in which.

DETAILED DESCRIPTION OF THE PREFERRED EMBODIMENT

Hereinafter, the actions and the effects of the present invention will be explained in more detail via specific examples of the invention. However, these examples are merely illustrative of the present invention and the scope of the invention should not be construed to be defined thereby.

In the chemical mechanical polishing conditioner with high quality abrasive particles of the present invention, the risk diamonds are judged by the abrasive screening device, and then these abrasive particles are used to manufacture the chemical mechanical polishing conditioner with high quality abrasive particles, and the risk diamond content to be tolerated and whether these abrasive particles to be used directly or not to manufacture a conditioner are decided by the user, thereby avoiding scratches and breakages produced on the polishing pad due to the risk diamonds during a chemical mechanical polishing process

Example 1

Figure 1:
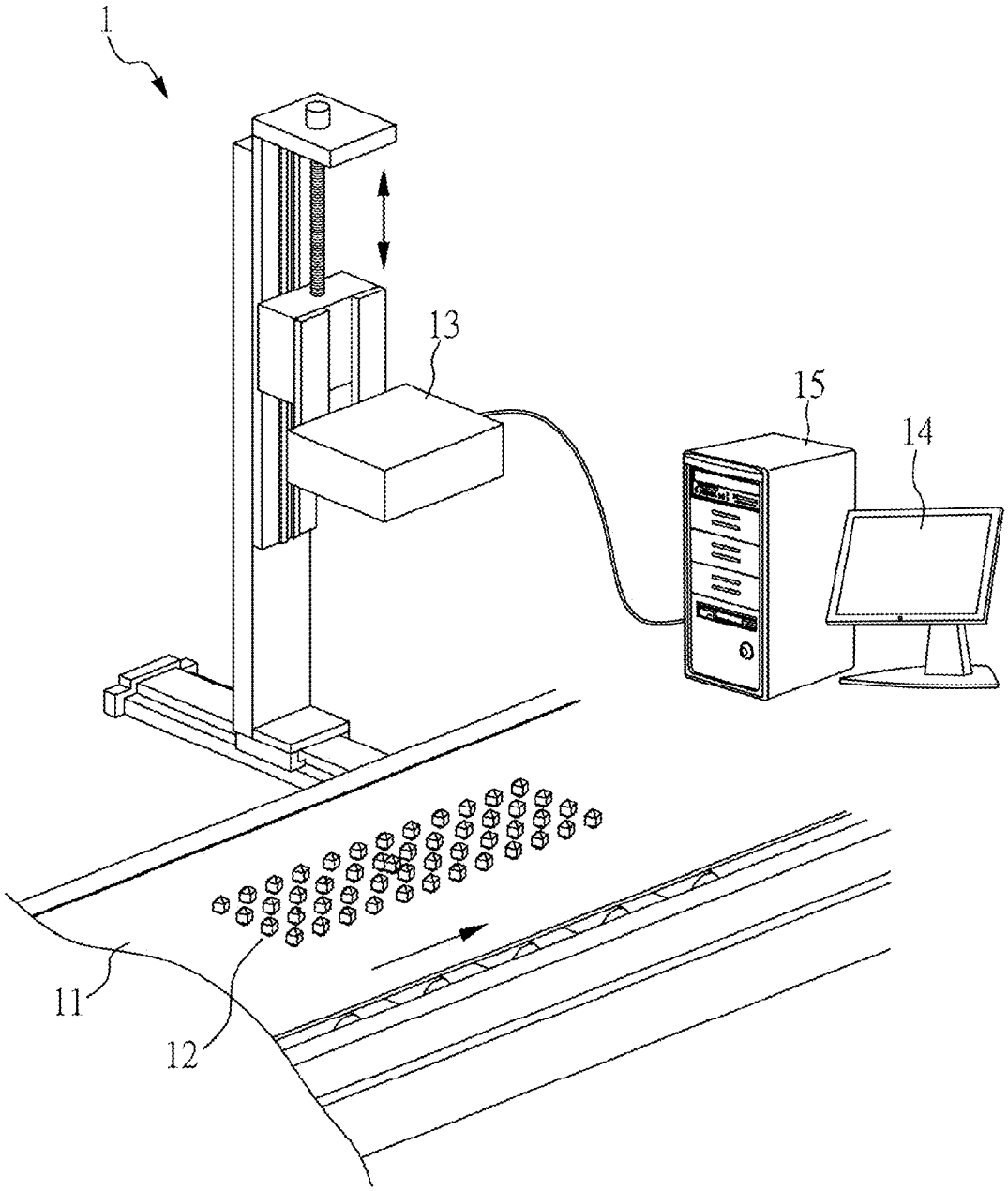
FIG. 1 shows a spatial diagram of an abrasive screening device of the chemical mechanical polishing conditioner with high quality abrasive particles of the present invention.

Please refer to FIG. 1, FIG. 1 shows a spatial diagram of an abrasive screening device of the chemical mechanical polishing conditioner with high quality abrasive particles of the present invention. As shown in FIG. 1, first, an abrasive screening device 1 is provided, which has an image capture device 13, an image recognition module 15 and a display device 14; wherein the image recognition module 15 is electrically connected with the image capture device 13 and the display 14, and then these abrasive particles 12 required of the chemical mechanical polishing conditioner are disposed on a conveyer belt 11 of the abrasive screening device 1; wherein these abrasive particles 12 have a risk diamond content, and the images of these abrasive particles 12 are captured by the image capture device 13. The image capture device 13 may be random image capture device, such as a camera or an industrial camera. Besides, the image capture device 13 may include a charge coupled device, and one or pluralities of images of these abrasive particles 12 are captured by the image capture device 13. The numbers of the captured images captured by the image capture device may be randomly varied based on resolutions of the image capture device or the user's detection standard. Subsequently, the captured images are transmitted into the image recognition module 15, and the geometric feature parameters, such as ellipticity and roughness, of every abrasive particle in the captured images are obtained by the image recognition module 15. Besides, the geometric feature parameters and a standard parameter set by the user are performed a parameter comparison to judge the risk diamonds included in these abrasive particles 12, for example, the standard parameter of the ellipticity to be 1.6 and the standard parameter of the roughness to be 1.10 are set, namely, when the ellipticity and roughness of every abrasive particle 12 in the captured images are beyond the standard parameter set by the user, the diamond particles are judged as the risk diamonds by the image recognition module 15. After the risk diamond content is judged by the abrasive screening device, the risk diamond content to be tolerated and these abrasive particles to be used directly or not to manufacture a conditioner are decided by the user. Alternatively, the risk diamonds are further removed by manual or mechanical methods, and then these abrasive particles are used to manufacture a conditioner; wherein the risk diamond content is a number percentage of the abrasive particles having the twin crystal structure or the internal crack structure based on these abrasive particles 12. The tolerance of the risk diamond content may be randomly varied based on user's requirements or different polishing conditions according to Example 1 of the present invention; wherein when the risk diamond content of these abrasive particles 12 is 20% or more, the risk diamond content may be judged too much and these abrasive particles 12 are not suitable for the chemical mechanical polishing conditioner. Therefore, whether these abrasive particles to be used directly or not to manufacture a conditioner are decided by the user; alternatively, the risk diamonds are further removed by manual or mechanical methods, and then these abrasive particles are used to manufacture a the chemical mechanical polishing conditioner with high quality abrasive particles after treatments.

Figure 2A:
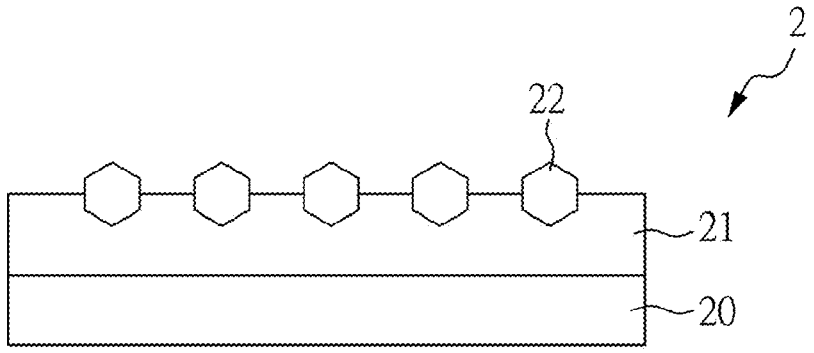
FIGS. 2A and 2B show a schematic diagram of the chemical mechanical polishing conditioner with high quality abrasive particles of the present invention.
Figure 2B:
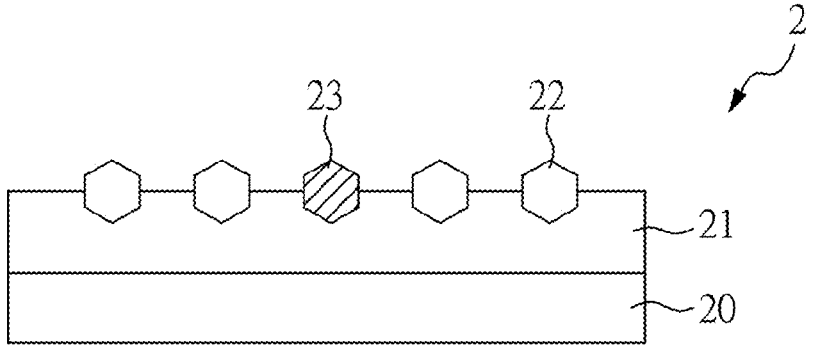

Please refer to FIGS. 2A and 2B, FIGS. 2A and 2B show a schematic diagram of the chemical mechanical polishing conditioner with high quality abrasive particles of the present invention. As shown in FIGS. 2A and 2B, the chemical mechanical polishing conditioner with high quality abrasive particles of the present invention, comprising: a substrate 20 made of stainless steel material; a binding layer 21 made of a nickel-based metallic brazing material; and a plurality of abrasive particles 22. Further, after the risk diamond content of the abrasive particles 22 is judged by the above-mentioned abrasive screening device 1, the risk diamonds to be tolerated and whether these abrasive particles to be used directly or not to manufacture a conditioner are decided by the user. Alternatively, the risk diamonds are further removed by manual or mechanical methods, and then these abrasive particles are used to manufacture a conditioner. Furthermore, a plurality of abrasive particles 22 embedded in the binding layer 21 by a heat-brazing method, and these abrasive particles 22 fixed to the surface of the substrate 20 by the binding layer 21; wherein these abrasive particles 22 are formed of artificial diamonds having particle sizes of 200 μm, and the abrasive particles 22 are disposed by using a known diamond distribution technique (for example, template distribution), and the spacing and arrangement of the abrasive particles 22 are controlled by the template (not shown in figures). Besides, tips of these abrasive particles 22 are all directed up to form the directivity of the polishing surface of tips, alternatively, tips of these abrasive particles 12 may be varied based on the user's requirements or the polishing conditions, and these abrasive particles 12 have the same or different directivity of tips. Moreover, the risk diamond content of these abrasive particles 22 in FIG. 2A is 0, and these abrasive particles 22 are used to manufacture a conditioner; therefore, these abrasive particles 22 located on the chemical mechanical polishing conditioner 2 do not include the risk diamonds (not shown in figures). Further, the tolerance of the risk diamond content of these abrasive particles 22 in FIG. 2B is 10%, and these abrasive particles 22 are used to manufacture a conditioner; therefore, these abrasive particles 22 located on the chemical mechanical polishing conditioner 2 include a few risk diamonds 23.

Example 2

Figure 3:
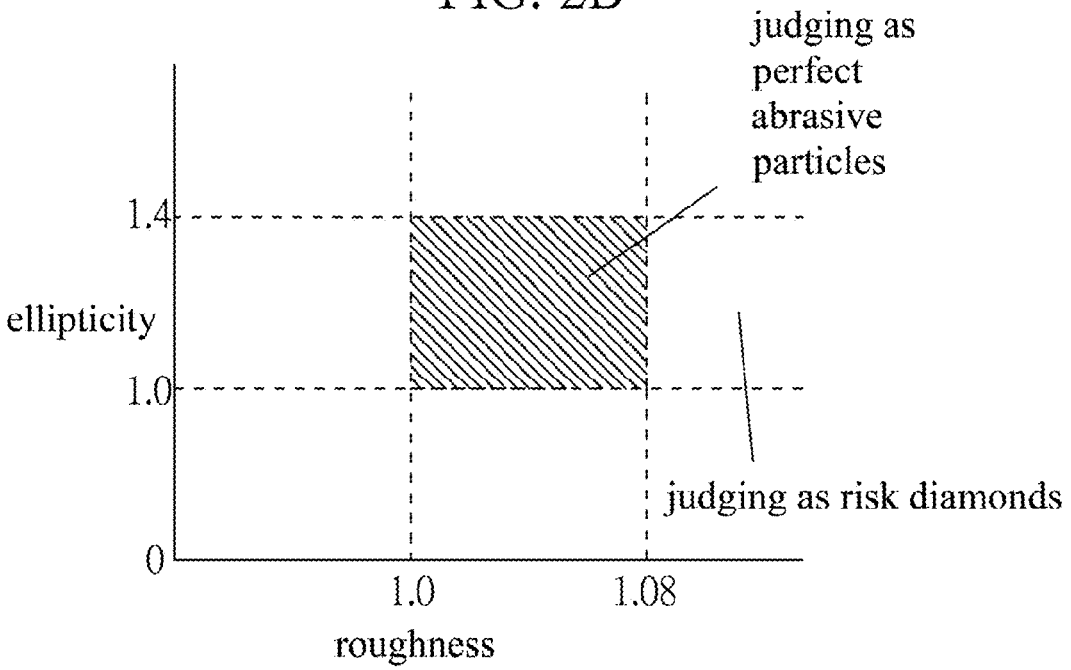
FIG. 3 shows a relational diagram of the geometric feature parameters of the abrasive screening device according to Example 2 of the present invention.

The device of the abrasive screening device of the chemical mechanical polishing conditioner with high quality abrasive particles of Example 2 is substantially the same as the above Example 1, but the differences are that the standard parameter of the ellipticity of Example 1 is 1.6 and the standard parameter of the roughness of Example 1 is 1.10; however, the standard parameter of the ellipticity of Example 2 is 1.4 and the standard parameter of the roughness of Example 1 is 1.08. Please refer to FIG. 1, these abrasive particles 12 are captured by the image capture device 13 and form one or a plurality of captured images. Further, the captured images are transmitted into the image recognition module 15; wherein the geometric feature parameter of every abrasive particle 12 in the captured images are obtained by the image recognition module 15, and the geometric feature parameter and the set standard parameter are performed a parameter comparison to judge the risk diamond content included in the abrasive particle 12 corresponding the geometric feature parameter, and then the risk diamond content to be tolerated and whether these abrasive particles to be used directly or not to manufacture a conditioner are decided by the user. Alternatively, the risk diamonds are further removed by manual or mechanical methods, and then these abrasive particles are used to manufacture a conditioner. Please refer to FIG. 3 (please refer to FIG. 2B together), FIG. 3 shows a relational diagram of the geometric feature parameters of the abrasive screening device according to Example 2 of the present invention, in FIG. 3, a horizontal ordinate is shown the roughness and a longitudinal coordinate is shown the ellipticity. When the measured results of the abrasive screening device are fallen out of the hatch area in a coordinate graphics, these abrasive particles are judged as risk diamonds and count these abrasive particles having the risk diamond content. Besides, when the measured results of the abrasive screening device are fallen inside the hatch area in a coordinate graphics, these abrasive particles are judged as perfect abrasive particles.

Figure 4:
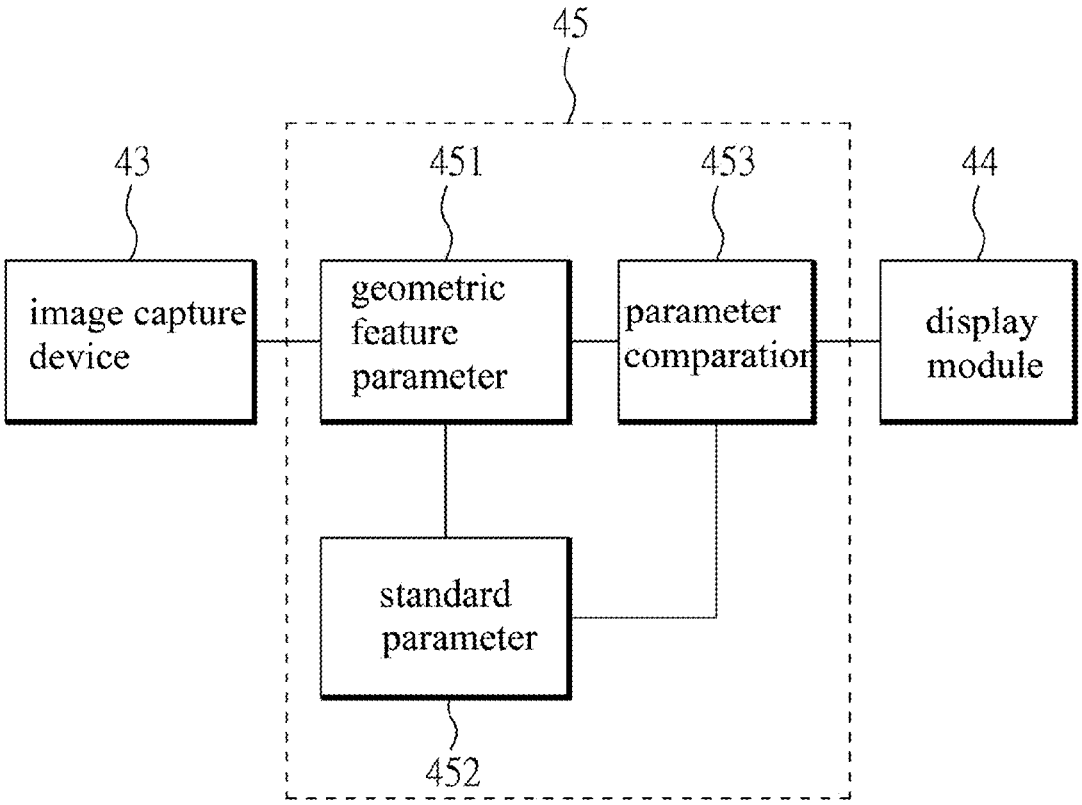
FIG. 4 shows a flow diagram of the screening device of the chemical mechanical polishing conditioners of the present invention.

Please refer to FIG. 4, FIG. 4 shows a flow diagram of the screening device of the chemical mechanical polishing conditioners of the present invention. As shown in FIG. 4, when the abrasive screening device of the chemical mechanical polishing conditioners is operated (please refer to FIG. 1 together), these abrasive particle 12 to be detected are disposed on the conveyer belt 11, and these abrasive particles 12 are formed one or a plurality of captured images by the image capture device 43. Further, the captured images are transmitted into the image recognition module 45, by which the geometric feature parameters 451 of every abrasive particle 12 are obtained, and the standard parameter 452 set by the user is performed a parameter comparison to judge the geometric feature parameters corresponding the diamond particles whether the risk diamonds or not. Besides, the above-mentioned results are transmitted into the display module 44 by the image recognition module 45 to show the geometric feature parameters and the judged results of every abrasive particle 12. Finally, the risk diamonds are judged by the abrasive screening device, and then the risk diamond content to be tolerated and whether these abrasive particles to be used directly or not to manufacture a conditioner are decided by the user. Alternatively, the risk diamonds are further removed by manual or mechanical methods, and then these abrasive particles are used to manufacture a conditioner.

In the chemical mechanical polishing conditioner with high quality abrasive particles of the present invention, the risk diamonds are judged by the abrasive screening device. It is different that the abrasive particles fixed on the chemical mechanical polishing conditioner are judged directly in the prior art. The geometric feature parameters of the abrasive particles are measured by the abrasive screening device of the present invention to judge the risk diamond content whether to conform to the user's requirements or not, and quality of these abrasive particles on the conditioner is improved. Therefore, the risk diamond content is judged by the geometric feature parameters in the chemical mechanical polishing conditioner with high quality abrasive particles of the present invention, and the risk diamond content to be tolerated and whether these abrasive particles to be used directly or not to manufacture a conditioner are decided by the user, thereby avoiding scratches and breakages produced on the polishing pad due to the risk diamonds during a chemical mechanical polishing process It should be understood that these examples are merely illustrative of the present invention and the scope of the invention should not be construed to be defined thereby, and the scope of the present invention will be limited only by the appended claims.

What is claimed is:

1. A chemical mechanical polishing conditioner with high quality abrasive particles, comprising:

a substrate;

a binding layer disposed on a surface of the substrate; and a plurality of abrasive particles embedded in the binding layer and fixed to the substrate by the binding layer;

wherein these abrasive particles have a risk diamond content measured by an abrasive screening device;

wherein every abrasive particle has a geometric feature parameter measured by the abrasive screening device to judge the risk diamond content, and the geometric feature parameter is an ellipticity and a roughness.

2. The chemical mechanical polishing conditioner with high quality abrasive particles of claim 1, wherein the risk diamond content is a number percentage of abrasive particles having a twin crystal structure or an internal crack structure based on these abrasive particles.

3. The chemical mechanical polishing conditioner with high quality abrasive particles of claim 2, wherein a number percentage of the abrasive particles having the twin crystal structure based on these abrasive particles is a twinning rate.

4. The chemical mechanical polishing conditioner with high quality abrasive particles of claim 1, wherein the risk diamond content is 20% or less.

5. The chemical mechanical polishing conditioner with high quality abrasive particles of claim 4, wherein the risk diamond content is 10% or less.

6. The chemical mechanical polishing conditioner with high quality abrasive particles of claim 1, wherein the abrasive screening device has an image capture device, an image recognition module and a display device.

7. The chemical mechanical polishing conditioner with high quality abrasive particles of claim 1, wherein the ellipticity is 1.0 to 1.6.

8. The chemical mechanical polishing conditioner with high quality abrasive particles of claim 7, wherein the ellipticity is 1.0 to 1.4.

9. The chemical mechanical polishing conditioner with high quality abrasive particles of claim 1, wherein the roughness is 1.00 to 1.10.

10. The chemical mechanical polishing conditioner with high quality abrasive particles of claim 9, wherein the roughness is 1.00 to 1.08.

11. The chemical mechanical polishing conditioner with high quality abrasive particles of claim 1, wherein the abrasive particles are artificial diamonds, nature diamonds, polycrystalline diamonds or cubic boron nitride.

12. The chemical mechanical polishing conditioner with high quality abrasive particles of claim 1, wherein the abrasive particles have a particle size of 30 to 600 μm.

13. The chemical mechanical polishing conditioner with high quality abrasive particles of claim 1, wherein a composition of the binding layer is made of a ceramic material, a brazing material, an electroplating material, a metallic material, or a polymer material.

14. The chemical mechanical polishing conditioner with high quality abrasive particles of claim 13, wherein the brazing material is at least one selected from the group consisting of iron, cobalt, nickel, chromium, manganese, silicon, aluminum, and combinations thereof.

15. The chemical mechanical polishing conditioner with high quality abrasive particles of claim 13, wherein the polymer material is epoxy resin, polyester resin, polyacrylic resin, phenolic resin.

16. The chemical mechanical polishing conditioner with high quality abrasive particles of claim 1, wherein the substrate is made of stainless steel substrate, mold steel substrate, metal alloy substrate, ceramic material substrate or polymer material substrate or combinations thereof.

* * * * *